US006794589B2

(12) United States Patent
Kubat et al.

(10) Patent No.: US 6,794,589 B2
(45) Date of Patent: Sep. 21, 2004

(54) MULTIPLE ELECTRICAL SWITCH ARRANGEMENT

(75) Inventors: Laurent Kubat, Dole (FR); Sylvain Rochon, Dole (FR); Bruno Michel, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/445,515

(22) Filed: May 27, 2003

(65) Prior Publication Data

US 2004/0000466 A1 Jan. 1, 2004

(30) Foreign Application Priority Data

May 30, 2002 (FR) ..... 02 06608

(51) Int. Cl.[7] ..... H01H 25/04
(52) U.S. Cl. ..... 200/6 A; 200/4
(58) Field of Search ..... 200/6 A, 5 A, 200/5 B, 5 C, 5 D, 5 E, 5 R, 4, 11 A, 11 R, 11 D, 11 DA, 11 E, 11 K, 17 R, 18

(56) References Cited

U.S. PATENT DOCUMENTS 5,621,196 A * 4/1997 Nishijima et al. ..... 200/6 A
5,889,242 A * 3/1999 Ishihara et al. ..... 200/6 A
6,593,909 B1 * 7/2003 Chou ..... 200/6 A
6,635,832 B1 * 10/2003 Oster et al. ..... 200/6 A

* cited by examiner

*Primary Examiner*—Lincoln Donovan
*Assistant Examiner*—M. Fishman
(74) *Attorney, Agent, or Firm*—Roger C. Turner

(57) ABSTRACT

An electrical switch arrangement includes a validation switch and four selection switches, all operated by an actuator (31) that can be pivoted about two horizontal axes and can be depressed. A dome center tripper (28) that can be depressed to operate the validation switch has a periphery engaged with an outer contact (44). The actuator has four feet (88) spaced in different horizontal directions from a vertical axis (33). A selection tripper (72) lying on top of the center tripper, has four branches (78) that each lies under one of the actuator feet. When the actuator is tilted, one of the feet depresses one of the branches against one of four selection contacts (56) to close a corresponding selection switch. When a selection switch is closed, current flows from the corresponding selection contact (56) through the selection tripper (72) and center tripper (28), to the outer contact (44), so only a single tail (58) (to be soldered to a circuit board) is required for each selection switch.

11 Claims, 7 Drawing Sheets

MULTIPLE ELECTRICAL SWITCH ARRANGEMENT

CROSS-REFERENCE

Applicant claims priority from French patent application 0206608, filed May 30, 2002.

BACKGROUND OF THE INVENTION

There are applications that require multiple switches that can be individually operated by manipulation of a single actuator. One example is in a portable telephone with a screen that displays telephone numbers, and switches that allow the numbers to scroll up or down. When the desired name and telephone number are displayed, a person operates a validation switch to initiate a call. Further advances allow a user to select additional functions by incorporating additional switches that can be operated by the same actuator. The entire switch arrangement may lie in a body having a width and length of 6 millimeters each.

The above types of switch arrangements with three or five switches can be implemented by an actuator that tilts about two horizontal axes to close one of four select switches, and that can be depressed to close a fifth validation switch. One arrangement involves mounting four pairs of switch elements on a frame with one element of each pair deflected against the other element of the pair when the actuator is tilted in a particular direction. This involves eight contacts, in addition to two contacts for the validation switch. The presence of ten contacts that each must be connected to a trace on the circuit board on which the switch lies, results in complication and extra expense, as well as extra space required on the circuit board. In portable telephones, space is at a premium, and a reduction in the required space taken by the switch arrangement would be of value.

SUMMARY OF THE INVENTION

In accordance with one embodiment of the present invention, an electrical switch arrangement is provided with multiple switches, especially with three or five switches, in which a single validation switch is operated by depressing an actuator along a vertical axis, and one of a plurality of selector switches is operated by tilting the actuator about a selected horizontal axis. The switch arrangement includes a center tripper of the dome type, with a periphery engaged with an outer contact and a center that can be snapped down by depressing the actuator. The arrangement also includes a selection tripper lying on top of the center tripper and having radiating branches. The actuator has feet that each lies over one of the branches.

When the actuator is tilted, one of its feet presses a corresponding selection tripper branch against a selection contact. Current then flows between the selection contact, through the selection tripper, and through the center tripper to the periphery of the center tripper that continually engages an outer contact. In an arrangement with five switches, only six contact tails are required to be soldered to traces on a circuit board.

The actuator includes a socket that forms the feet that depress the selection tripper branches and that forms a vertical passage that slideably receives a pusher. The pusher can be separately depressed to reliably operate the validation switch, without depressing the socket whose feet operate the selection switches.

The novel features of the invention are set forth with particularity in the appended claims. The invention will be best understood from the following description when used in conjunction with the accompanying drawings.

DESCRIPTION OF THE PREFERRED EMBODIMENTS

1. Limited Description

Figure 1:
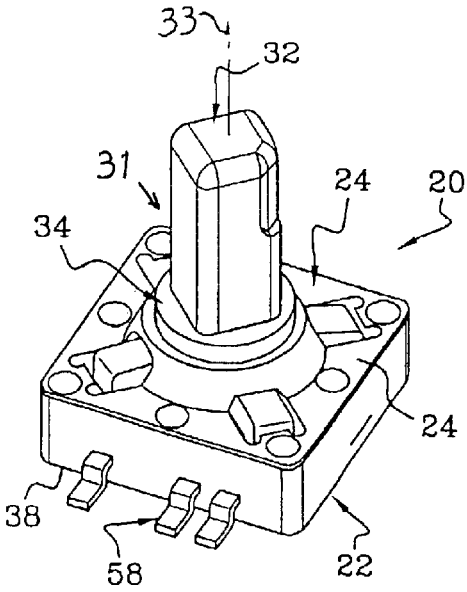
FIG. 1 is a top isometric view of a switch arrangement with five switches, of one embodiment of the present invention.
Figure 3:
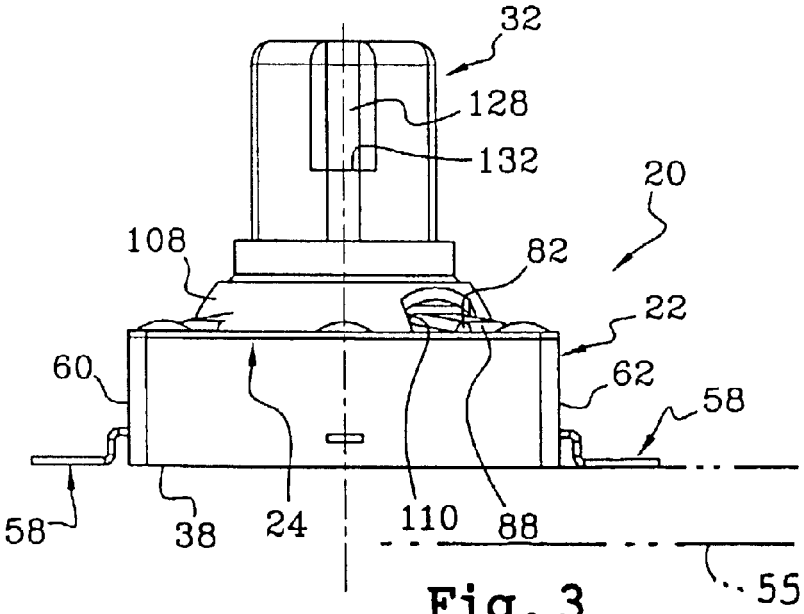
FIG. 3 is a side elevation view of the switch of FIG. 1.

As shown in FIG. 1, a switch arrangement 20 of the present invention includes a frame with a body 22 of molded plastic and a cover 24 which may be formed of sheet metal. An actuator 31, which includes a pusher 32 and a socket 34, can be manipulated to close any one or more of five electrical switches. A validation switch is closed when the pusher is depressed along a vertical axis 33. One of four selection switches are closed when the pusher is tilted towards a selected one of four corners of the body. The five switches have tails 58 in two groups that project from opposite sides of the base, and that can be soldered to traces on a circuit board 55 (FIG. 3). For use in a portable telephone, the body may have a horizontal width and length of 6 mm each.

Figure 2:
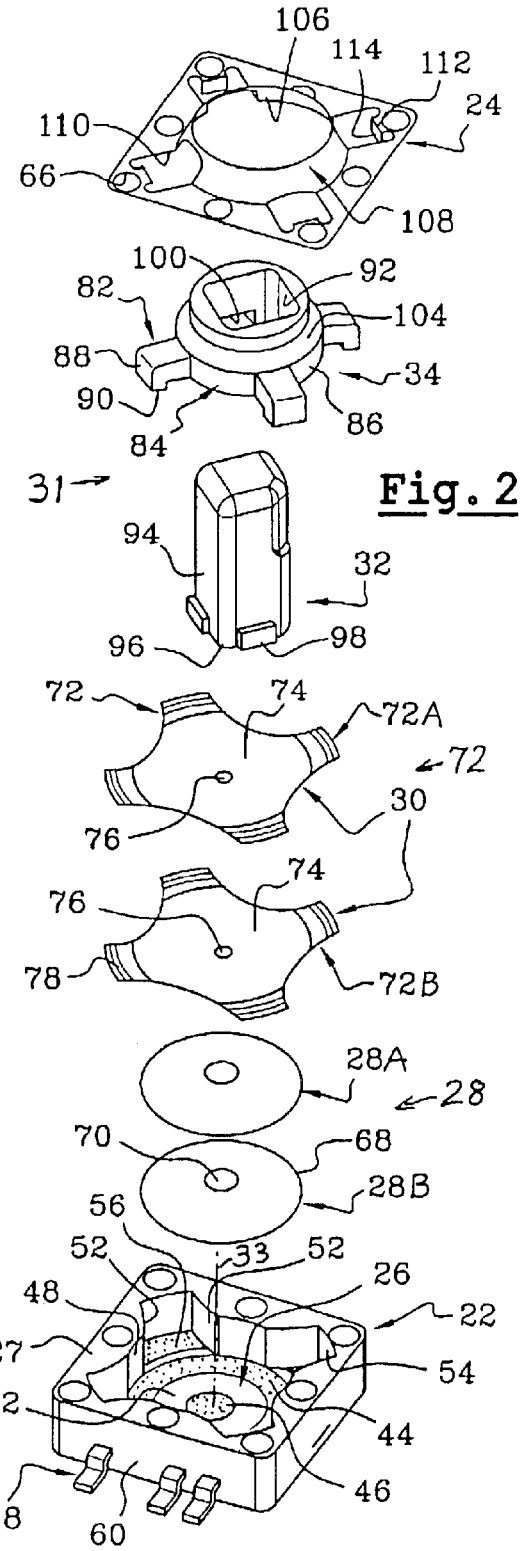
FIG. 2 is an exploded isometric view showing the components of the switch of FIG. 1.

FIG. 2 shows that the body 22 has an upwardly-opening cavity 26 with a cavity bottom wall 42 (which may not be flat and which may have steps). A center contact 46 lies on the bottom wall on the largely vertical axis 33. An outer contact 44 is radially spaced from the center contact. Four select contacts 56 each lies in one of four recesses 54 in the body. A snap center tripper 28 which is formed of sheet metal, includes two identical tripper elements 28A, 28B that lie on one another and in a center portion of the cavity. The center tripper 28 has a peripheral portion 68 that lies on the outer contact 44, and has a middle portion 70 that lies over the center contact 46. When the middle portion 70 is depressed beyond a certain height, its resistance to further depression suddenly decreases and it snaps down against the center contact 46. This closes a validation switch, by allowing current to flow between the center and outer contacts 46, 44 through the conductive center tripper 28.

A select tripper 72, which includes two sheet metal element 72A, 72B that lie on one another, is used to close a selected one of four select switches. The select tripper 72 has four branches 78 that project in four horizontal and perpendicular directions from a middle portion 74. It is noted that the middle portion has an upwardly-projecting dimple 76.

The actuator 31 of FIG. 2 includes a pusher 32 and a socket 34. The socket 34 has a largely vertical passage 92 and a square section 94 of the pusher is slideably disposed within the vertical passage. When the pusher 32 is depressed, it depresses the middle portion 74 of the select tripper 72, which depresses the middle portion 70 of the center tripper 28, thereby causing the center tripper middle portion 70 to snap down against the center contact 46 on the bottom of the cavity 26.

The socket 34 has four feet 88 that are radially (with respect to axis 33). spaced from the vertical passage 92. The feet lie at the ends of extensions 82 in the form of arms and the feet have lower surfaces 90.

The cover 24 in FIG. 2 is formed of sheet metal and has holes 66 that receive corresponding projections on the upper face 27 of the base. The cover has a downwardly-concave and preferably spherical surface portion 106 that can abut a corresponding spherical surface portion 104 on the socket, to hold down the socket. The cover has a plurality of cut-outs 110 through which the extensions 82 on the socket can project.

Figure 5:
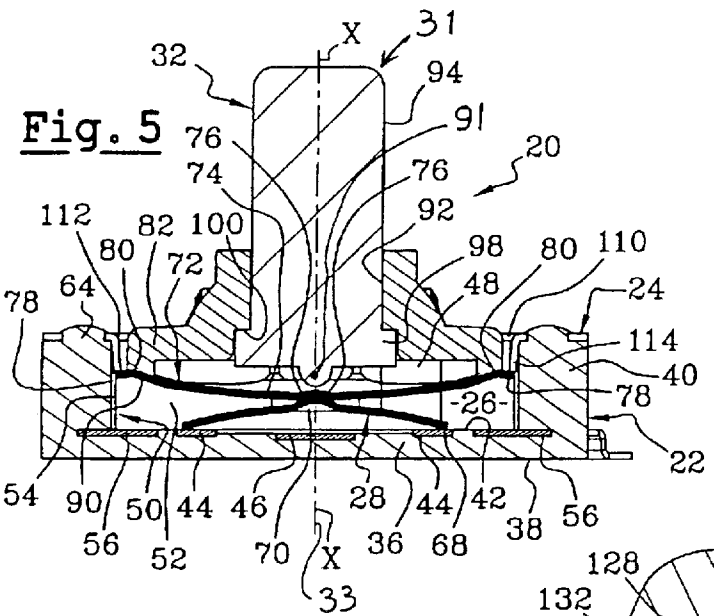
FIG. 5 is a sectional view taken along line 5—5 of FIG. 4.
Figure 8:
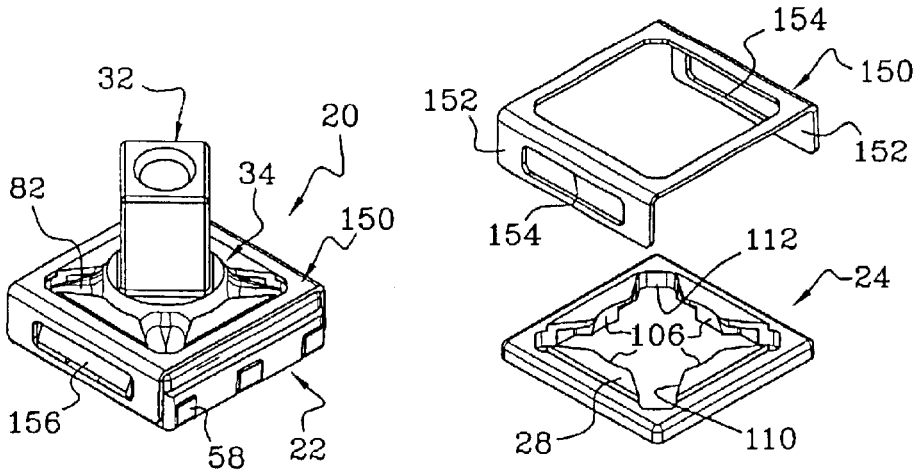
FIG. 8 is an isometric view of a switch of a second embodiment of the invention wherein the actuator is a single member and the cover is formed by two pieces.
Figure 9:
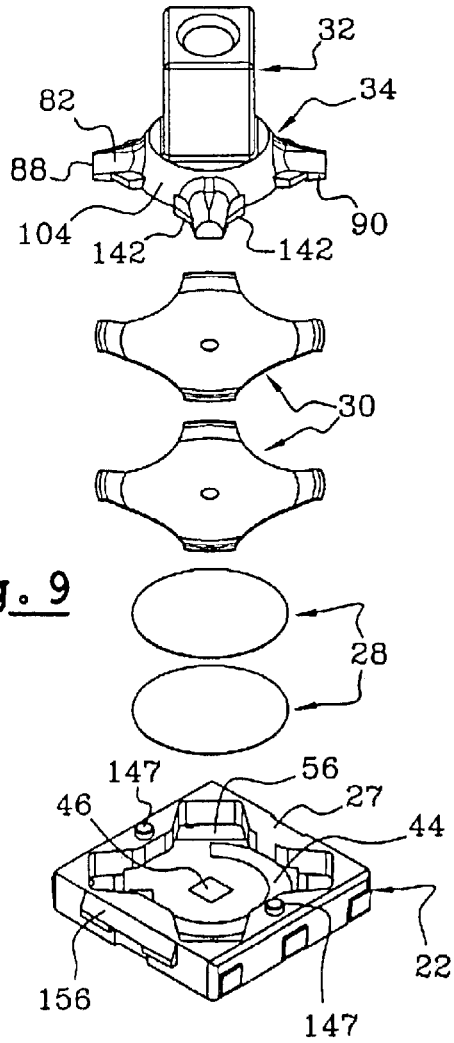
FIG. 9 is an exploded isometric view of the switch of FIG. 8.
Figure 10:
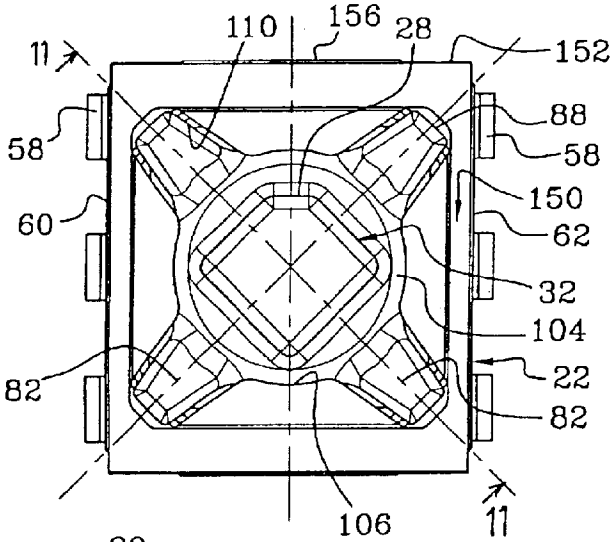
FIG. 10 is a plan view of the switch of FIG. 8.
Figure 12:
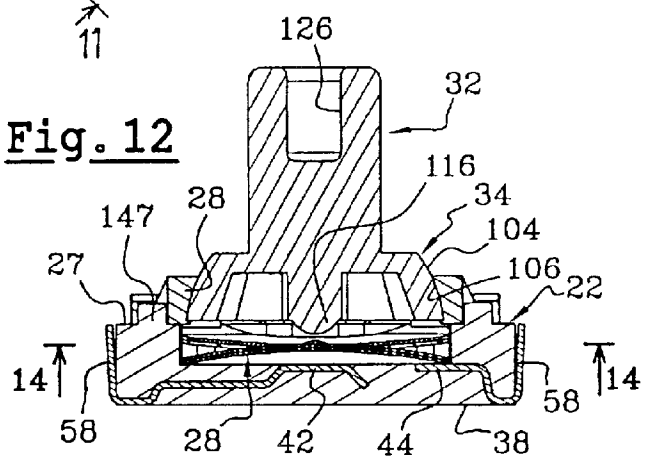
FIG. 12 is another side sectional view of FIG. 10.

FIG. 5 shows the switch arrangement 20 in its initial position, wherein none of the five switches is closed. To control these switches, a person grasps the pusher 32. To close the single verification switch, the person presses down on the pusher. This causes a knob, shown in FIG. 6 at 116, to depress the centers of the two trippers 28, 72 (FIG. 5) so the bottom of the tripper 28 engages the center contact 46.

To close one of the four select switches, a person who is grasping the pusher 32 of FIG. 5, tilts the pusher about a horizontal axis passing through a point 91 which is at the center of an imaginary sphere. This causes a corresponding one of the feet on arms 82 to depress a corresponding one of the select tripper branches 78 to move it down against a selected one of the four select contacts 56. Each of the branches 78 extends at a generally upward incline from the middle portion at dimple 74 of the select tripper. With the select tripper having a concave upper surface, a properly constructed select tripper has its branch 78 snapped down against the select contact 56. The actuator 31 can be tilted in the opposite direction to cause the opposite branch of the select tripper to snap down against the opposite select contact 56.

When a select switch is closed, by a branch 78 snapping down against a corresponding select contact 56, current can flow from the select contact 56 through the select tripper 72, through the center tripper 28, to the outer contact 44. The center tripper 28 is slightly deformed in the initial position, to promote low resistance contact between the two trippers and avoid "rattling". The two trippers each have a dimple, with one dimple nested in the other, to provide even better contact. Since the center tripper peripheral portion 68 is in constant engagement with the outer contact 44, current can flow between the select contact 56 and through the two trippers to the outer contact 44.

The outer contact 44 that is continually engaged by the periphery of the center tripper 28, constitutes a common terminal for all five switches. That is, whenever one of the five switches is closed, current flows from or to the center contact 46 (when the verification switch is closed) or from one of the four select contacts 56, and through the common contact formed by the outer contact 44. This reduces the number of tails, each leading from one of the five contacts. The tails include six tails extending from center and outer contacts 46,44 and from the four select contacts 56, that must be soldered to traces on the circuit board. An alternative would be to provide two tails for each of the five switches, which would result in ten tails to be soldered to the circuit board, instead of six. A reduction in the number of tails reduces cost and conserves the limited available space on the circuit board.

Figure 4:
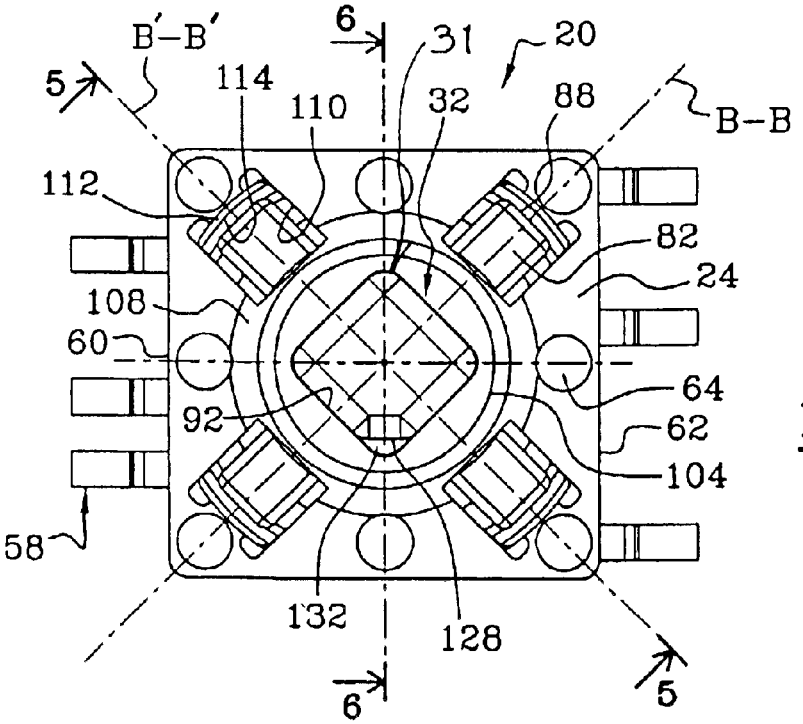
FIG. 4 is a plan view of the switch of FIG. 3.

FIG. 4 shows that the four select feet 88 lie near the corners of the square frame formed by the body and cover 24. The actuator 31 can pivot about two perpendicular horizontal axes, including a first axis B—B and a second axis B'—B' to tilt in any one of the four directions about the two axes to close a selected one of the four select switches.

FIG. 2 shows that the select tripper 72 (comprising two elements) has scallop cutouts that lie against cavity walls 48, and that the branches 78 fit moderately closely within the body recesses 54. This helps locate the selection tripper 72 to assure that the branches are always over the corresponding select contacts 56.

2. Detailed Description

In the following description, similar components are denoted by the same reference numerals.

The electrical switch 20 shown in FIGS. 1 to 5 consists of a frame in two parts, a lower part 22, made in the form of a body, or base molded in plastic, and a cover or upper part 24 which, in the first embodiment, is a closure plate made of cut, folded and pressed sheet metal.

The base 22 is the element of the switch arrangement 20 which carries the various fixed contacts of the switches, or switching channels, and it defines a cavity 26 which is open in the upper horizontal face 27 of the base.

The cavity 26 accommodates the other constituent components of the switch arrangement which are superimposed vertically. The components comprise a lower center or validation tripper dome 28, of generally known design, an intermediate select tripper 30 incorporating the tripper elements, in this case in the form of a star with four branches, and a common actuator for the various switching channels of the switch.

Here, the common actuator is made in two pieces, one 32 of which is the main body of the actuator in the form of a vertical pusher and the other 34 of which accommodates the pusher 32 by sliding and comprises the four side arms 82 with feet 88 for controlling the switches or selection channels.

The components 28 to 34 are accommodated in the cavity 26 which is closed by the upper closure plate 24 which keeps the components inside the switch. The base 22 is of square parallelepiped shape closed at the bottom by its lower horizontal wall 36 which may, for example, rest on a printed circuit board (not shown) by its lower face 38. The inner cavity 26 is defined by the lower wall 36 and by the side wall 40.

The top 42 of the insulative base lower wall 36 is in this case a horizontal flat bottom of the cavity which accommodates various fixed contacts, each one of which is substantially flush, by means of its upper conducting face, with the upper face of the bottom 42 made of an insulating material.

Thus, the cavity bottom 42 comprises a first fixed outer contact 44 of annular shape which, according to the teachings of the invention, is the fixed contact common to the various switching channels of the switch 20.

The annular contact 44 is centered on the vertical axis X—X which forms the general axis of symmetry of the switch and especially of the base 22.

The cavity bottom 42 also comprises a fixed validation contact 46 which is made in the form of a fixed central pad centered on the axis X—X.

Apart from the bottom 42, the cavity 26 is defined laterally by four convex cylindrical surface portions 48 having a vertical axis centered on the axis X—X and which extend substantially vertically in line with the external periphery of the common annular fixed contact 44.

Between each pair of adjacent cylindrical surfaces 48, the cavity 26 comprises a recess 54 of radial orientation which is defined by two substantially parallel walls 52 of radial orientation and by a radial transverse end wall of vertical orientation.

In the top view, the cavity 26 has the general shape of a star with four branches distributed angularly at 90° and each recess 54 of which extends in the direction of a corner of the base 22.

In the bottom of each recess 54, the bottom 42 of the cavity holds a fixed selection contact 56.

The bottom 42 thus supports six fixed contacts, each one of which is electrically connected to the outside by a corresponding connection tail belonging to the set of six connection tails 58 which extend outwards from two opposed side faces 60 and 62 of the base.

In the examples shown in the figures, the base 22, with its fixed contacts, is made according to a conventional L5 technique of overmolding the body 22 made of an insulating material around the fixed contacts.

To close the cavity by means of the plate 24, the upper face 27 of the body 22 comprises a set of lugs 64 (FIG. 5) which are accommodated through corresponding holes 66 in the plate 24 and which are hot crimped.

The central tripper 28 (FIG. 2) of the validation switch is in this case made in two identical superimposed pieces, each one of which is a dome in the general shape of a spherical cap with its convexity oriented upwards.

The tripper 28 (FIG. 5) is made from a conducting material and permanently rests, by means of its lower annular edge 68, on the common fixed annular contact 44.

In the first embodiment, the top central region 70 (FIG. 5) is slightly curved with a radius less than that of the main part of the dome or tripper 28.

According to a known design, the dome 28 is a resiliently deformable element, which is shown in its rest state in the figures. The dome is capable of being deformed by applying a generally vertical force to it in its central region 70 in order to cause a sudden change in state in which its central region or part 70 comes into contact with the fixed validation contact 46. This establishes an electrical link between the two fixed contacts 44 and 46 or validation switching channel.

According to the teachings of the invention, each of the four similar selection switching channels consists of the common annular fixed contact 44 and of an associated fixed selection contact 56.

A selection switching thus assumes the establishment of an indirect electrical link between the two fixed contacts 56 and 44, through the central validation dome 28 which is itself always in electrical contact with the common annular contact 44.

To this end, and according to the teachings of the invention, a common select tripper 30 is provided, in this case made in two identical superimposed pieces. The select tripper brings together four selection trippers formed by branches 72, each one of which includes a lateral branch of overall radial orientation which extends outwards from a central portion 74 in the general shape of a spherical cap whose concavity is oriented vertically upwards.

The central portion 74 comprises at its center a curved region of smaller diameter with its convexity oriented upwards. The curved small region is provided in order to cooperate with the central region 70 of the central tripper, or validation member 28 in order to center the selection validation star 30 with respect to the central validation tripper member 28. The tripper member 28 is itself held in a centered position with respect to the common annular fixed contact 44 in so far as, as will be explained herein below, the selection validation star tripper 30 is itself overall centered in the housing with respect to the axis X—X of the switch.

As can especially be seen in FIG. 5, each selection validation branch 72 extends radially outwards and upwards from the central portion 74 in the form of a spherical cap.

Each free end of a branch 72 forms a selection contact edge, in the shape of a circular arc, which is capable, as will be explained hereinbelow, of coming into electrical contact with a fixed selection contact 56 arranged vertically in line with the associated branch 72 below the latter, in the bottom 42 of the base 22.

Each branch 78 is shaped and bent so as to form a tripper with sudden actuation, in the same way as the central dome 28, when urging the branch 78 close to its folded free end section 80, by means an associated side selection arm 82 of the single actuator.

To this end, as can be seen in the figures, the socket 34 of the actuator comprises a central part 84 in the general shape of a socket as defined by a side wall 86, from which each arm 82 extends radially outwards.

Near its free external radial end, each arm 4 comprises a vertical foot 88, oriented downwards, whose inner end surface 90 cooperates with the upper face of the bend 80 of the associated side selection branch in order to act on the latter.

The socket 84 defines on the inside a vertical passage 92 of square section which is complementary to the external square section 94 of the pusher 32 which is thus mounted so that it can slide vertically inside the socket 84.

At its horizontal lower end 96, the pusher 32 comprises four radial locking pads 98, each one of which is capable of being accommodated in a complementary notch 100 formed in the lower face 102 of a part 84 of socket 34. This limits the upward vertical sliding movements of the pusher 32, in so far as the pads 98 come into abutment against the upper vertical wall of the notches 100. The pusher 94 is thus free to slide vertically downwards, from the position in FIGS. 5 and 6, from its maximum high position shown in these figures.

The socket 34 is extended upwards by a spherical cap section 104 (FIG. 6) whose upper convex face is oriented upwards and which is provided in order to cooperate with the facing complementary concave inner face 106 of the central section 108. The inner face 106 of is in the shape of a truncated spherical cap of the upper closure plate 24 so as to form a ball-joint articulation of the socket 34 with respect to the closure plate 24, and therefore with respect to the insulating base 22.

As will be explained hereinbelow, the common actuator consisting of the pusher 32 and the socket 34 with its side arms 82, is capable of tilting around two tilting axes B—B and B'—B' (FIG. 4) which are perpendicular to each other and intersect at a point located on the axis X—X. These two tilting axes of course are aligned with the pairs of corresponding side selection arms 82 as can be seen in FIG. 4.

Finally, as can be seen in FIGS. 2 and 5, the cover, or upper plate 24 comprises four radially oriented cutouts 110 aligned with the arms 82 which allow the latter to pass slightly outside the bottom of the switch.

Each cutout 110 is limited radially outwards by a transverse edge 112 which is extended vertically downwards by a vertical pad 114 for positioning, in the high position, the free end 78–80 of the associated selection tripper branch 72. The branch bears, by means of its upper face, on the lower free end facing the pad 114.

Thus, in the rest position, each selection tripper branch 72 (FIG. 5) bears vertically upwards against the free end of an associated pad 114 which it will "leave" during selection actuation for the purpose of switching the associated selection channel to this branch.

The resilient stack, which is mounted so that it is slightly compressed vertically, consisting of the central validation dome 28 and of the pieces 30, ensures the upward resilient return of the socket 34 with its convex spherical surface 104 bearing axially against the concave surface 106 of the upper closure plate 24.

We will now describe the operating mode of the switch 20 according to the first embodiment that has just been described.

In this embodiment, it is possible for the actuating pusher 32 to be moved vertically, parallel to its general axis, independently of the socket piece 34 with its selection arms 82.

Figure 6:
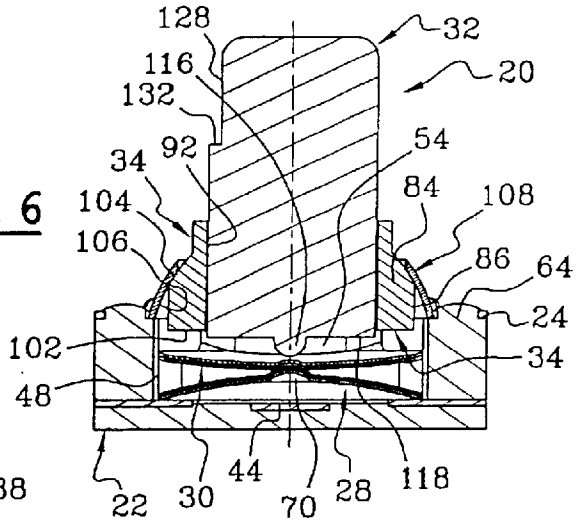
FIG. 6 is a sectional view taken along line 6—6 of FIG. 4.

It is thus possible, starting from the high rest position that is illustrated in FIGS. 5 and 6, to initiate only a single switching operation by pressing vertically downwards on the pusher, which then slide downwards inside the socket 34.

By means of this vertical downwards travel, the central knob 116, which projects vertically downwards below the lower horizontal face 118 of the pusher 32, then presses on the top 76 of the central tripper validation member 28 until initiating the validation operation with, in addition, the perception of a tactile sensation, or effect, by the user. The cooperation of the knob 116 with a central raised region 70 of the central validation dome 28 makes the sudden "inversion", or change of state, of the central dome easier.

During the vertical downwards travel of the central part of the validation dome 28, the central portion 74–76 of the selection tripper piece 30 also moves simultaneously downwards. However, there is no change in the state of the selection tripper branches 72, that is to say that there is no unwanted switching of any selection channel.

When the user desires to activate a selection channel, he only has to tilt the whole actuator in two parts 32–34 around one of the two tilting axes B—B, B'—B' and in the clockwise or anticlockwise direction which corresponds to the desired selection channel.

This tilting is obtained by acting substantially on the high part of the pusher 32, which projects vertically outside the switch 20 so that the lower socket 84 is simultaneously tilted sideways with the corresponding selection arm 82 which tilts downwards by pressing by its lower free end 88, 90, on the free facing end 80 of the associated selection branch 72.

This tilting movement initiates the sudden change in state of the branch 72 which is pressed vertically. Its free end edge 78 establishes an electrical contact with the associated fixed selection contact 56, establishing an electrical link between this contact 50 and the common fixed contact 44, through the central conducting dome 28.

During this tilting movement, the branch which is diametrically opposite that which establishes the selection switching remains vertically pressing upwards against the associated pad 114 of the closure plate 24 and no action takes place on the central validation dome. When the user releases his lateral or transverse force from the top part of the pusher 32, the actuator 31 returns to its rest position shown in the figures. Such return is the effect of the resilient return force exerted by the branch 72 which is acted on, and by the other two branches offset by 90°. The other branches have flexed slightly during tilting, but with less travel given the proximity of the tilting axes B—B, B'—B' to the point of contact between the lower ends 90 of the two aligned selection arms 82 which cooperate with the upper facing portions of the free ends 80 of the two aligned selection branches.

In the tilted selection position, and given the independence of the central pusher 32 with respect to the actuating piece 34 which carries the arms 82, it is possible for the user then to initiate validation switching by acting on the pusher. The pusher then initiates, as described above, a change in state of the central validation dome 28, under the same conditions as those described above and this being so although the movement axis of the pusher 32 is then inclined with respect to the vertical.

Figure 7:
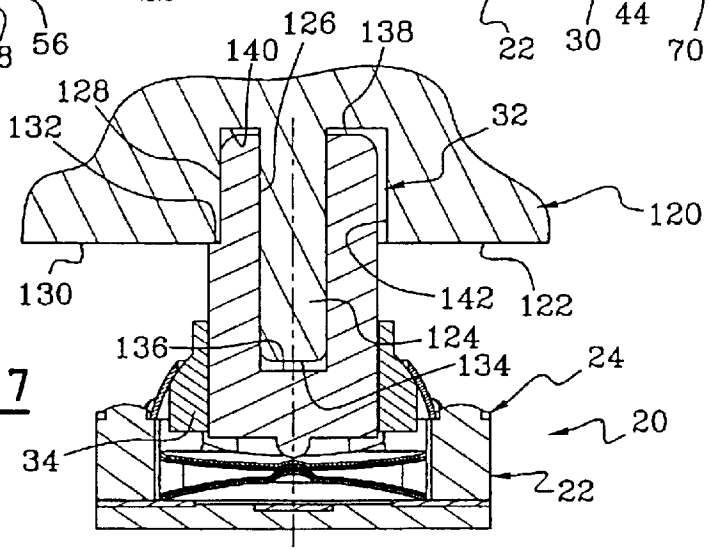
FIG. 7 is a sectional view similar to that of FIG. 6, but with the actuator including a handling button.

To handle the actuator in two parts 32, 34, an operating button 120 is generally provided, an exemplary embodiment of which is shown in FIG. 7.

The button comprises a body 122 which comprises a vertical central pin or finger 124 which is mounted tightly inside a complementary central hole 126 formed in the body of the pusher 32.

The angular orientation of the button 120 with respect to the switch is obtained by means of a polarization flap 128 formed in a corner of the pusher 32.

The vertical position of the button 120 with respect to the pusher 32 is obtained by the abutment of its lower face 130 onto the top 132 of the notch defining the flap 128.

Moreover, axial clearances are provided between the lower end 134 of the pin 124 and the bottom 136 of the hole 126, and between the upper face 138 of the pusher 32 and the bottom 140 of the hole 142 which accommodates the upper end of the pusher 32.

We will now describe the second embodiment illustrated in FIGS. 8 to 14 through comparison and contrast with that which has just been described with reference to the first embodiment.

In the first embodiment, the tails, or connection pins 58 are bent and lie parallel and in a coplanar manner with the lower face 38 of the base 22. In the second embodiment, the connection tails 58 (FIG. 8) are folded vertically upwards along vertical side faces 60 and 62 of the insulating base 22, whose general design is virtually identical in all aspects to that described above, and especially with regard to the arrangement oi the various fixed contacts.

Figure 11:
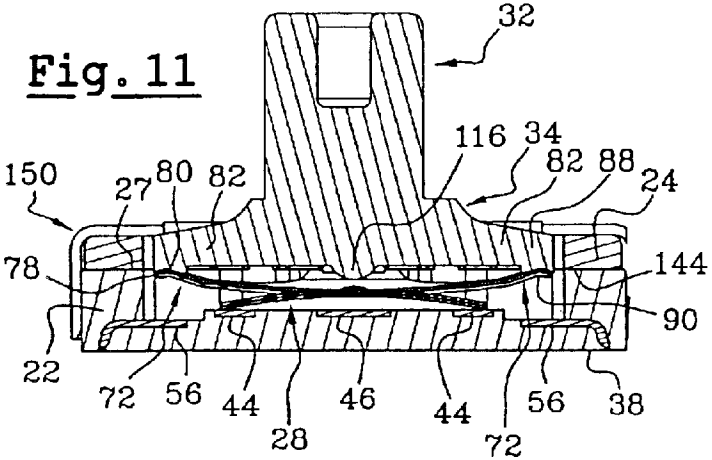
FIG. 11 is a sectional view taken on line 11—11 of FIG. 10.

As can be seen especially in FIG. 11, the upper face of the fixed selection contacts 56 is in this case vertically offset downwards with respect to the plane of the upper face of the common fixed contact 44 and of the central fixed validation contact 46.

The single actuator 32–34 is made in a single piece molded from an insulating material.

Near its radially inner root, which connects it to the central body of the lower part 34 of the actuator, each selection arm 82 (FIG. 9) comprises two opposed side bosses 142.

The upper closure plate 24 is a plate molded from plastic, whose lower flat face 144 (FIG. 11) bears vertically or the upper face 27 of the base 22. The plate comprises a series of four holes 146 (FIG. 13) which open out into the lower face 114, two of which accommodate two positioning pins 147 formed to be facing on the upper face 27 of the base 22.

The upper plate 24 is fixed, in the assembled position, to the base 22 by an upper metal cage 150, whose side faces 152 each comprise a recess 154 for catching onto a complementary notch 156 formed in a corresponding side face of the base 22.

In its lower face, and on each side of each cutout 110 in which a branch 82 lies, the upper closure plate 24 comprises a pair of opposed side notches 148 which accommodate the bosses or lugs 142 of the associated arm 82.

In this second embodiment, the free ends 80 of each selection tripper branch 72 always press mutually against the lower end face 90 of the associated side selection arm 82, and this being so whatever the movements of the actuator 32, 34.

As above, the lower part 34 of the actuator, with its four side arms 82, is still oriented angularly with respect to the base 22 since the arms 82 and the branches 72 are accommodated in the radial recesses of the base 22 and in the cutouts 110 of the upper plate 24.

During the validation actuation, the two complementary guiding surfaces in convex 104 and concave spherical cap sections are separated from each other.

When tilting the actuator 32, 34, in order to initiate selection switching, the lugs 142 associated with the branch 82 opposite the selection arm 82 that it is desired to use, come into abutment in the bottom of the associated recesses 158 of the closure plate 24, at the end of the travel of the actuator 32, 34.

Figure 15:
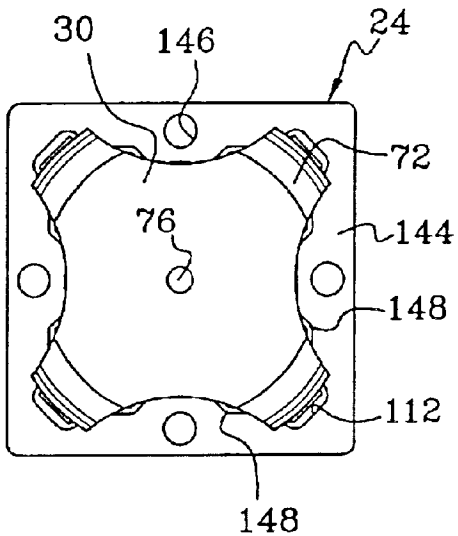
FIG. 15 is a bottom view of the upper plate 24 of FIG. 11, and also showing the selection tripper.
Figure 14:
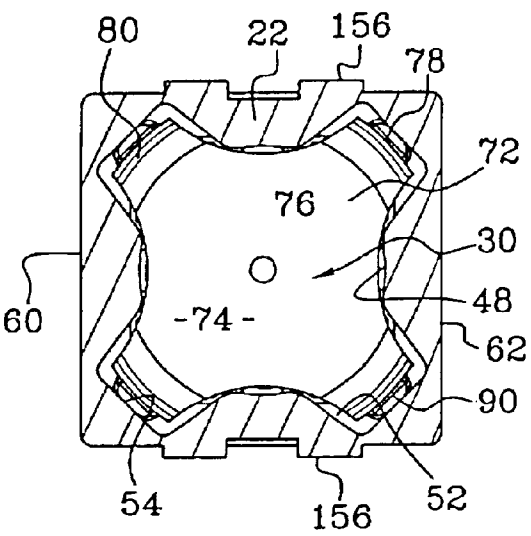
FIG. 14 is a bottom sectional view taken on line 14—14 of FIG. 12.
Figure 13:
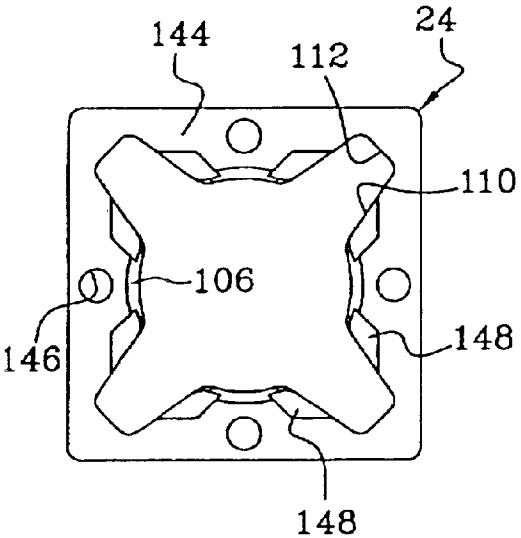
FIG. 13 is a bottom view of the switch of FIG. 8.

As can be seen in FIG. 15, the width of each selection branch 72 is such that it lies opposite facing portions of the lower plane face 144 of the upper plate 24.

Thus, when tilting for the purpose of selector switching, the free end of the branch 72, which is diametrically opposed to the selection branch which is being acted on by means of a corresponding side arm, leaves the lower face 90 of the free end 88 of the associated arm 82 by resting elastically supported against the facing portions of the lower face 144 of the upper plate 24.

Figure 16:
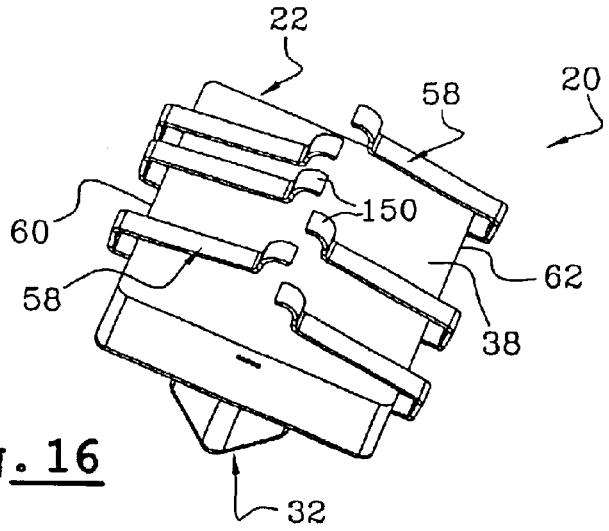
FIG. 16 is a bottom isometric view of a switch arrangement of another embodiment of the invention wherein the contact tails that connect to a circuit board are in the form of flexible beams.
Figure 17:
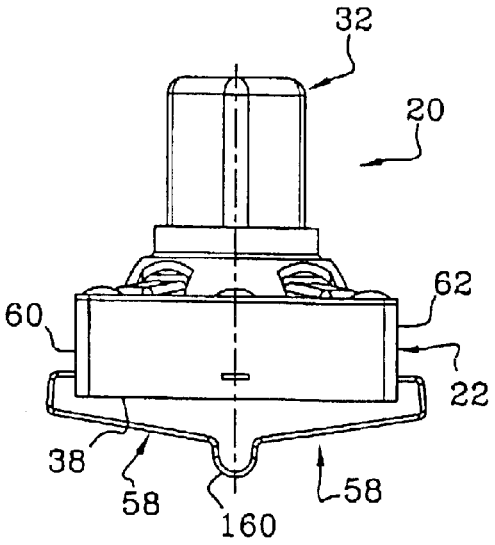
FIG. 17 is a side elevation view of the switch arrangement of FIG. 16.
Figure 18:
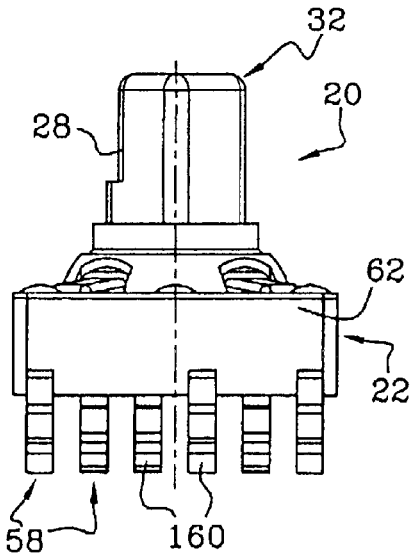
FIG. 18 is a side elevation view of the switch arrangement of FIG. 17.

In the variant embodiment shown in FIGS. 16 to 18, the connection tails 58 are folded downwards with a hairpin-shaped profile which allows their elastic deformation, each one thereby operating as a flexing beam.

Furthermore, the free elastic support end 160, on the upper face of a conducting track belonging to a printed circuit board, is aligned with the other ends 160. This makes it possible to reduce the overall size on the printed circuit board.

The various designs according to the invention enable great miniaturization of a switch with five switching channels.

Thus, by way of example, the side of the base measures 6 mm and the total height of the switch, including the pusher, is also about 6 mm.

According to a variant embodiment (not shown), it is possible to remove the lower validation domes 28.

The trippers 30 then rest by means of their central region on the central fixed contact 46 with which they are always in electrical contact, thus forming the common fixed contact.

The switch still has its four selection switching channels, as described above, and the validation channel corresponds to the electrical switching of the common fixed central contact with at least three fixed selection contacts 56.

Although terms such as "above," "below," "lying on," etc. are used to describe the switch assembly as it is illustrated, it should be understood that the switch assembly and its parts can be used in any orientation with respect to the Earth.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical switch arrangement which includes a body that has a cavity with a cavity bottom, and an actuator mounted on said body and lying on a vertical axis, wherein:

said actuator has at least a first pair of selection feet lying on horizontally opposite sides of said axis;

an electrically conductive selection tripper lying in said cavity and having at least a first pair of electrically connected branches that each lies under one of said selection feet;

a first contact in continuous electrical connection with said selection tripper;

at least a first pair of selection contacts, each selection contact lying under a different one of said branches of said selection tripper;

said actuator being tiltable in opposite directions to lower a selected one of said first pair of selection feet to depress a corresponding one of said branches against one of said selection contacts and establish electrical contact between them, each of said branches being positioned to be moved downward by said actuator against one of said selection contacts.

2. The switch arrangement described in claim 1 including:

an electrically conductive center tripper lying under and in direct contact with said selection tripper;

a center contact lying under a middle of said center tripper to be engaged by said center tripper when said middle of said center tripper is depressed, said center tripper having a peripheral portion;

said first contact lies in continuous direct electrical contact with said peripheral portion of said central tripper, whereby an electrical circuit is established between one of said selection contacts and said first contact through the selection tripper and center tripper.

3. The switch arrangement described in claim 2 wherein:

said center tripper is of largely dome shape with a concave bottom surface and a convex upper surface;

said branches of said selection tripper extend at upward inclines away from a center of said selection tripper.

4. The switch arrangement described in claim 1 wherein:

said body is of square shade as seen in a plan view, with four corners;

said cavity has cavity walls that form a center cavity portion, said selection tripper having a middle portion lying in said center cavity portion, and said cavity walls form cavity recesses that project radially from said center cavity portion in to each of a plurality of said corners and that receive said branches of said selection tripper, to control horizontal positions of said branches while allowing the branches to move vertically.

5. The switch arrangement described in claim 1 wherein:

said actuator is tiltable about first and second perpendicular horizontal axes;

said actuator has a second pair of selection feet spaced from said vertical axis in opposite largely horizontal directions that are perpendicular to said first pair of selection feet;

said selection tripper has a second pair of branches that each lies under one of said selection feet of said second pair; and including:

a second pair of selection contacts, each lying under one of said branches of said second pair, each branch of said second pair of branches being positioned to be deflected by one of said selection feet of said second pair of selection feet to directly engage one of said selection contacts of said second pair of selection contacts.

6. An electrical switch arrangement which includes a body forming a cavity that opens upwardly along a primarily vertical axis and that has a cavity bottom wall, a center contact lying on said bottom wall at a first location on said axis and an outer contact lying on said bottom wall at a second location spaced from said axis, an actuator mounted on said body and moveable along said vertical axis, and a conductive snap center tripper lying in said cavity and having a peripheral portion in constant engagement with said outer contact, said center contact middle lying under a portion of said actuator, wherein:

said actuator includes at least two feet radially spaced in primarily opposite directions from said axis, said actuator being pivotable about at least one horizontal axis to lower a selected one of said two feet;

an electrically conductive selection tripper lying in said cavity and being in electrical connection to said center tripper, said selection tripper having at least two branches projecting largely radially away from said axis, with each branch lying under one of said feet of said actuator;

at least two selection contacts, each lying under one of said branches of said selection tripper, said actuator and said branches of said selection tripper constructed so that tilt of said actuator to lower one of said feet causes the lowered foot to push a corresponding selection tripper branch directly against a corresponding selection contact.

7. The switch arrangement described in claim 6 wherein:

said center tripper is formed of sheet metal and has a convex upper surface and a bump lying on said vertical axis;

said selection tripper lies over said center tripper and has a center with a bump, said bumps on said trippers being received one within the other, whereby to resist horizontal movement of one tripper with respect to the other.

8. The switch assembly described in claim 6 wherein:

said base is molded of insulative material;

said socket has a largely upwardly facing convex surface lying on an imaginary sphere having a sphere center lying on said vertical axis;

a cover that lies over said base and that has a largely downwardly facing concave surface lying on said imaginary sphere;

said cover is formed from a piece of sheet metal and is fastened to a top of said base.

9. The switch arrangement described in claim 6 wherein:

said cover has four holes that each receive an upper part of one of said feet.

10. The switch arrangement described in claim 6 wherein:

said body is of rectangular shape as seen in a plan view, and said cavity has four peripheral cavity projections each lying at one corner of said rectangle that each receives one of said branches of said selection tripper, to help control the rotational position of the selection tripper.

11. The switch arrangement described in claim 6 wherein:

said branches of said selection tripper each extends at an upward incline away from said axis, and against a lower surface of one of said feet.

* * * * *